US010053337B2

(12) United States Patent
Turek et al.

(10) Patent No.: US 10,053,337 B2
(45) Date of Patent: Aug. 21, 2018

(54) PEOPLE CONVEYOR AND METHOD OF OPERATING A PEOPLE CONVEYOR

(71) Applicant: Otis Elevator Company, Farmington, CT (US)

(72) Inventors: Alexander Turek, Münchendorf (AT); Alois Senger, Gresten (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/782,082

(22) Filed: Oct. 12, 2017

(65) Prior Publication Data

US 2018/0105399 A1 Apr. 19, 2018

(30) Foreign Application Priority Data

Oct. 14, 2016 (EP) ..... 16193910

(51) Int. Cl.
*B66B 29/00* (2006.01)
*B66B 29/04* (2006.01)
*B66B 21/02* (2006.01)

(52) U.S. Cl.
CPC ..... *B66B 29/04* (2013.01); *B66B 21/02* (2013.01)

(58) Field of Classification Search
CPC ..... B66B 29/00; B66B 29/04
USPC ..... 198/322, 323, 335
See application file for complete search history.

(56) References Cited

U.S. PATENT DOCUMENTS 5,001,459 A 3/1991 Jacoby et al.
5,072,820 A * 12/1991 Steffen ..... B66B 29/005 198/323
5,092,446 A * 3/1992 Sullivan, Jr. ..... B66B 29/04 198/323
5,245,315 A * 9/1993 Johnson ..... B66B 29/04 198/323

(Continued)

FOREIGN PATENT DOCUMENTS

CN 201914827 U 8/2011
DE 2006542 A1 8/1971

(Continued)

OTHER PUBLICATIONS

European Search Report for application EP 16193910.3, dated Apr. 11, 2017, 8 pgs.

*Primary Examiner* — Douglas A Hess
(74) *Attorney, Agent, or Firm* — Cantor Colburn LLP

(57) ABSTRACT

A people conveyor comprises two landing areas located at two opposing ends of the people conveyor; a movable conveying element extending between the two landing areas and configured for conveying passengers between the two landing areas; a handrail extending parallel to the conveying element between the two landing areas and configured for moving with the conveying element; a handrail exit/entry portion located at one of the landing areas and configured for receiving a return portion of the handrail; and a safety switch assembly provided at the handrail exit/entry portion and configured for stopping the handrail when activated. The safety switch assembly comprises at least one sensor surface providing a touch sensor for detecting any part of a human body, in particular a finger, approaching and/or touching at least one of the at least one sensor surfaces.

14 Claims, 6 Drawing Sheets

(56) References Cited

U.S. PATENT DOCUMENTS 6,241,070 B1 * 6/2001 Loder ..... B66B 29/06 198/323
6,267,219 B1 * 7/2001 Spannhake ..... B66B 27/00 198/322
6,971,496 B1 * 12/2005 Nurnberg ..... B66B 29/00 198/323
6,988,607 B2 1/2006 Blondiau et al.
7,404,477 B1 * 7/2008 Toennisson ..... B66B 29/005 198/323
7,552,812 B2 * 6/2009 Gonzalez Alemany ..... B66B 29/04 198/323
8,205,735 B2 * 6/2012 Behan ..... B66B 29/005 198/323
8,708,130 B2 * 4/2014 De Coi ..... B66B 25/00 198/322
8,727,095 B2 * 5/2014 Trojer ..... G01N 22/02 198/322
8,783,437 B2 * 7/2014 Simola ..... B66B 25/00 198/322
9,181,066 B2 * 11/2015 Fan ..... B66B 29/08
9,272,882 B2 3/2016 Soldner et al.
9,731,904 B2 * 8/2017 Raassina ..... B66B 25/006
9,792,796 B1 * 10/2017 Lauka ..... G08B 21/02
2003/0136635 A1 * 7/2003 Lauch
2008/0011580 A1 1/2008 Mustalahti et al.
2012/0182721 A1 7/2012 Pesson et al.
2012/0283870 A1 11/2012 Senger et al.
2013/0020174 A1 1/2013 Trojer et al.
2016/0237690 A1 8/2016 Hyde et al.
2016/0240052 A1 8/2016 Hyde et al.

FOREIGN PATENT DOCUMENTS

EP 0420061 A2 4/1991
EP 2100842 A1 9/2009
EP 2404860 A1 1/2012
JP H01317987 A 12/1989
JP 2010247948 A 11/2010

* cited by examiner

PEOPLE CONVEYOR AND METHOD OF OPERATING A PEOPLE CONVEYOR

The invention relates to a people conveyor with a moving handrail and a sensor which is configured for preventing parts of the human body from being jammed or squeezed between the moving handrail and a stationary handrail exit/entry portion. The invention also relates to a method of operating such a people conveyor.

A people conveyor such as an escalator or a moving walkway is usually provided with balustrades extending on both sides along a longitudinal (conveying) direction of the people conveyor. A moving handrail in the form of a belt usually circulates in a closed loop around each balustrade.

There is some risk that parts of a human body, in particular fingers, are trapped and jammed between the moving handrail and a stationary handrail exit/entry portion provided at an end of the balustrade. In order to reduce said risk, the handrail exit/entry portion is provided with a mechanical safety switch which stops the movement of the handrail (and usually the movement of the whole people conveyor) when activated.

There, however, is still some risk that a human body part, in particular a child's finger, is jammed and injured before the movement of the handrail is completely stopped. In addition, with this solution there is some risk of unnecessary shut-off times of the people conveyor after the safety switch has been activated.

It therefore would be beneficial to provide an improved people conveyor which reliably prevents parts of a human body from being trapped and jammed at the handrail exit/entry portion. Further, it would be helpful to minimize the shut-off times of the people conveyor.

According to an exemplary embodiment of the invention, a people conveyor comprises two landing areas located at two opposing ends of the conveyor; a movable conveying element extending between the two landing areas and configured for conveying passengers between the two landing areas; a handrail, which extends parallel to the conveying element between the two landing areas and which is configured for moving with the conveying element; and handrail exit/entry portions. The handrail in particular may extend along a balustrade extending parallel to the conveying element between the two landing areas. At least one handrail exit/entry portion is provided at each of the landing areas, in particular at the bottom of the balustrade, and configured for emitting/receiving a return portion of the handrail. Depending on the conveyance direction of the people conveyor, each handrail exit/entry portion may act as handrail exit portion or as handrail entry portion, respectively.

A safety switch assembly is provided at a handrail exit/entry portion and configured for stopping the handrail when activated. When the people conveyor is configured for being operated in only one conveyance direction, it might be sufficient to provide a safety switch assembly on only one end of the people conveyor, i.e. the end comprising the handrail entry portion receiving a return portion of the handrail. In case the people conveyor is switchable between two conveying directions, safety switch assemblies preferably should be provided at both ends of the people conveyor, as, depending on the actual conveying direction, both ends may act as handrail exit portion or as handrail entry portion, respectively.

The safety switch assembly comprises at least one sensor surface providing a touch sensor for detecting any part of a human body, in particular a finger, approaching and/or touching at least one of the at least one sensor surfaces.

According to an exemplary embodiment of the invention, a method of operating a people conveyor comprises issuing an optical and/or an acoustical alarm signal and/or reducing the speed of the handrail element in case the touch sensor detects any part of a human body, in particular a finger, approaching and/or touching at least one of the at least one sensor surfaces.

By detecting any part of a human body, in particular a finger, approaching and/or touching the sensor surface even before the safety switch assembly is (mechanically) activated, the operational security of the people conveyor is enhanced. By issuing an alarm signal and/or reducing the speed of the handrail element, the dangerous situation detected by the touch sensor may be resolved before the part of the human body is trapped. In consequence, stopping the handrail element or even the conveying element of the people conveyor, which is inconvenient for potential passengers and requires human interaction for restarting the operation of the people conveyor, may be avoided.

Exemplary embodiments of the invention will be described with respect to the enclosed figures.

Figure 1:
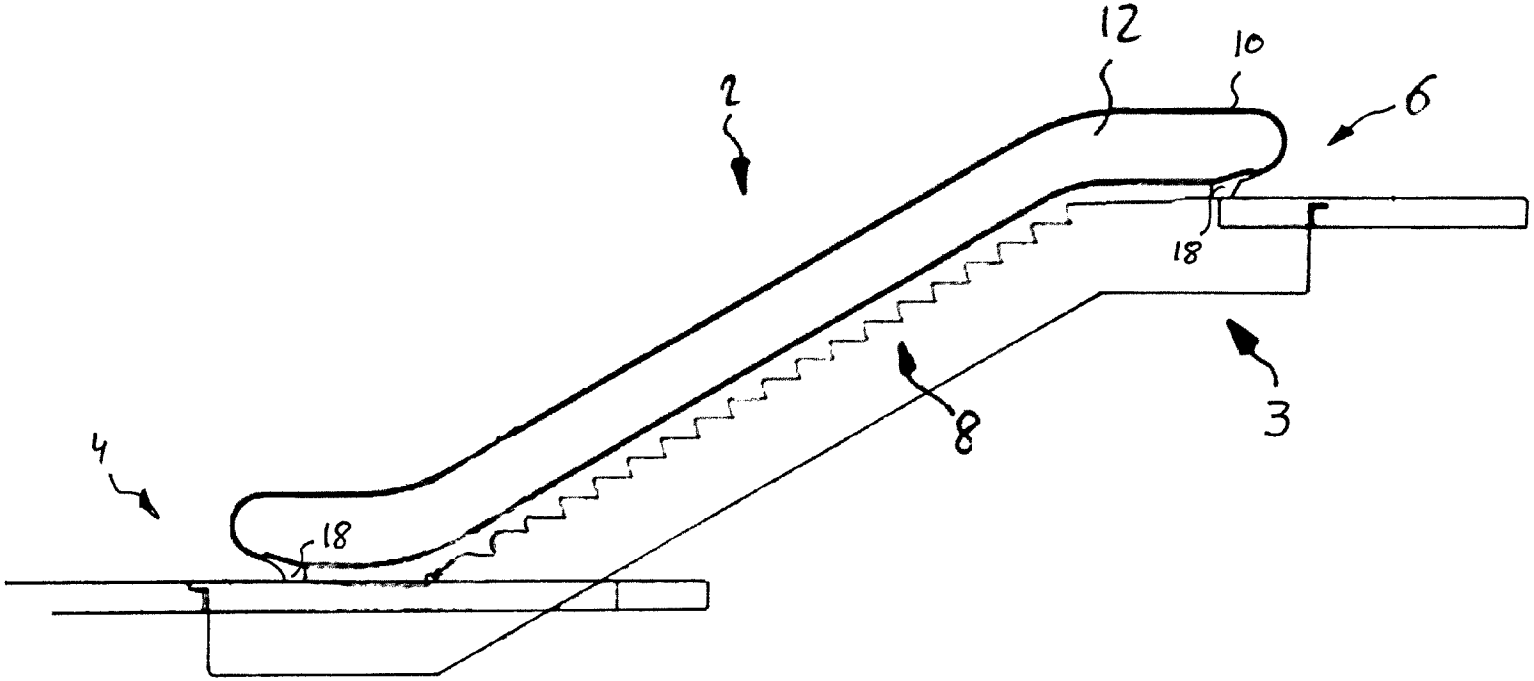
FIG. 1 depicts a schematic side view of a people conveyor according to an exemplary embodiment of the invention.
Figure 2:
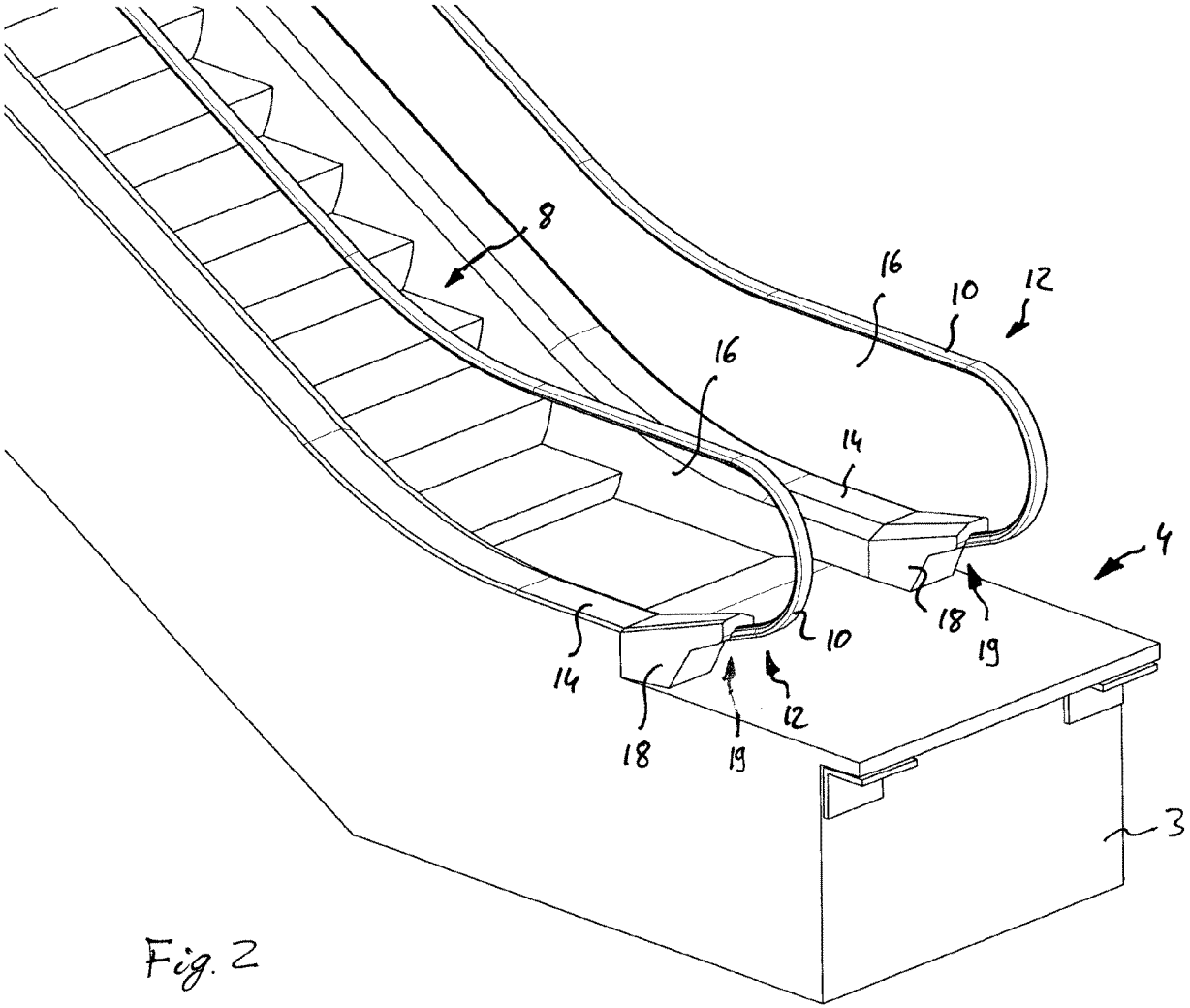
FIG. 2 depicts a perspective view of a lower landing area of a people conveyor according to an exemplary embodiment of the invention.
Figure 3:
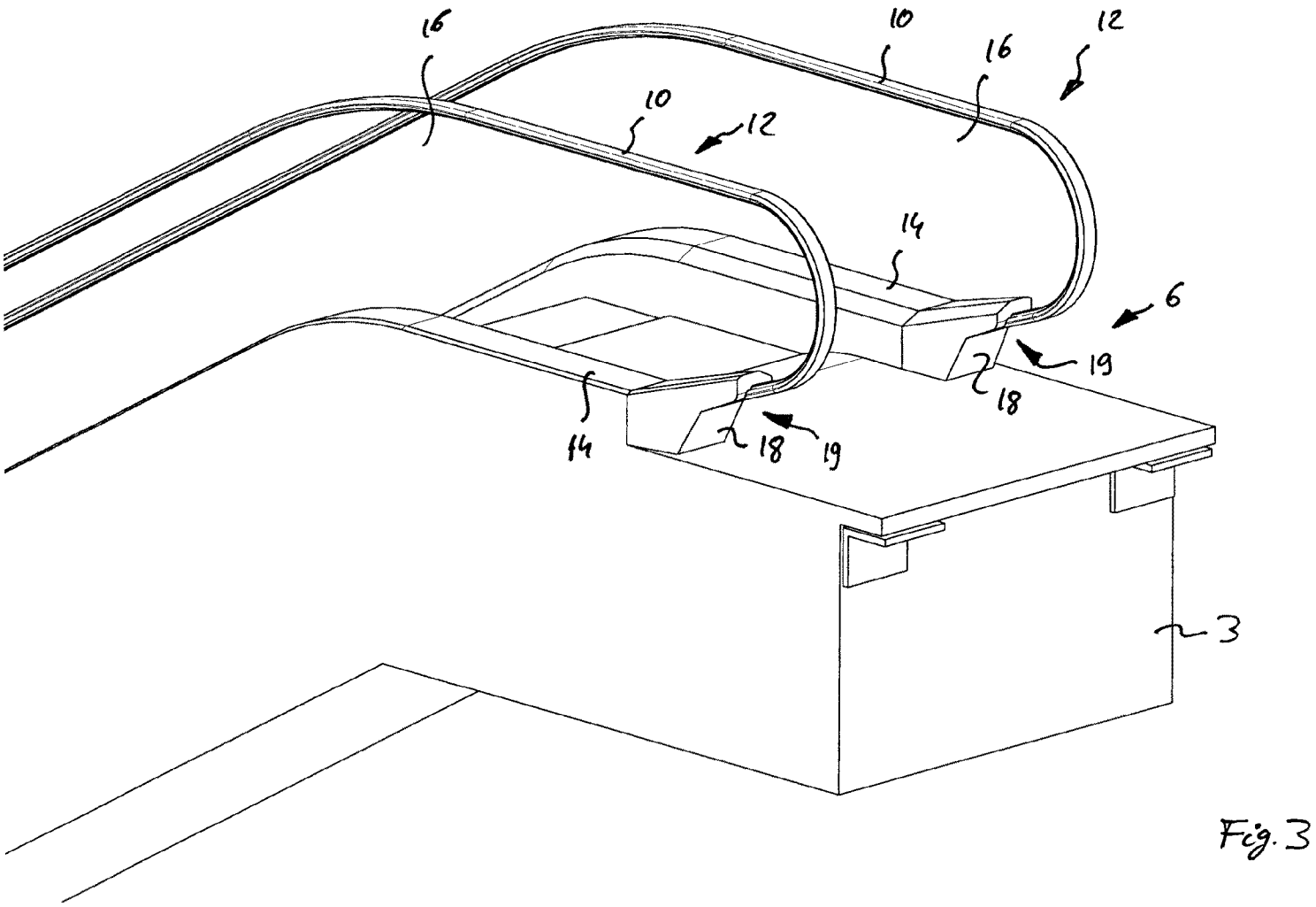
FIG. 3 depicts a perspective view of an upper landing area of a people conveyor according to an exemplary embodiment of the invention.

FIG. 1 shows a schematic side view of a people conveyor 2, which in this case is provided in the form of an escalator. The skilled person, however, will easily understand that the invention may be applied similarly to a horizontal or inclined moving walkway. FIG. 2 depicts a perspective view of a lower landing area 4 of the people conveyor 2, and FIG. 3 depicts a perspective view of an upper landing area 6 of the people conveyor 2.

The people conveyor 2 comprises a truss 3 extending between the lower landing area 4 and the upper landing area 6. The truss 3 supports a movable conveying element 8, which in the case of an escalator is a step chain, and two balustrades 12 (only one of which is visible in FIG. 1) extending parallel to the conveying element 8 on both lateral sides of the conveying element 8. Each balustrade 12 comprises a lower base portion 14 and an upper portion 16, which is supported by the base portion 14. The upper portions 16 may be made of a transparent material, such as glass or acrylic glass, as shown in FIGS. 2 and 3. In an alternative embodiment, which is not shown in the Figures, the upper portions 16 may be made of an intransparent material, such as metal, in particular steel, stainless steel or aluminum. The upper portions 16 of the balustrade 12 may extend vertically, as shown in FIGS. 2 and 3. This is typical for transparent balustrades. In an alternative embodiment, which is not shown in the Figures, the upper portions 16 may be arranged at an angle with respect to the vertical direction, which is typical for balustrades made of an intransparent material such as metal.

A moving handrail 10, which is provided in the form of a belt forming a closed loop, extends and circulates around each of the balustrades 12.

Handrail exit/entry boxes 18 providing handrail exit/entry portions 19 are arranged at the ends of the lower base portions 14. Each of the handrail exit/entry boxes 18 comprises an opening (not visible in FIGS. 1 to 3) for receiving a lower return portion of the handrail 10. In operation, the handrail 10 will exit from or enter into the respective opening, depending on the conveying direction.

Figure 4:
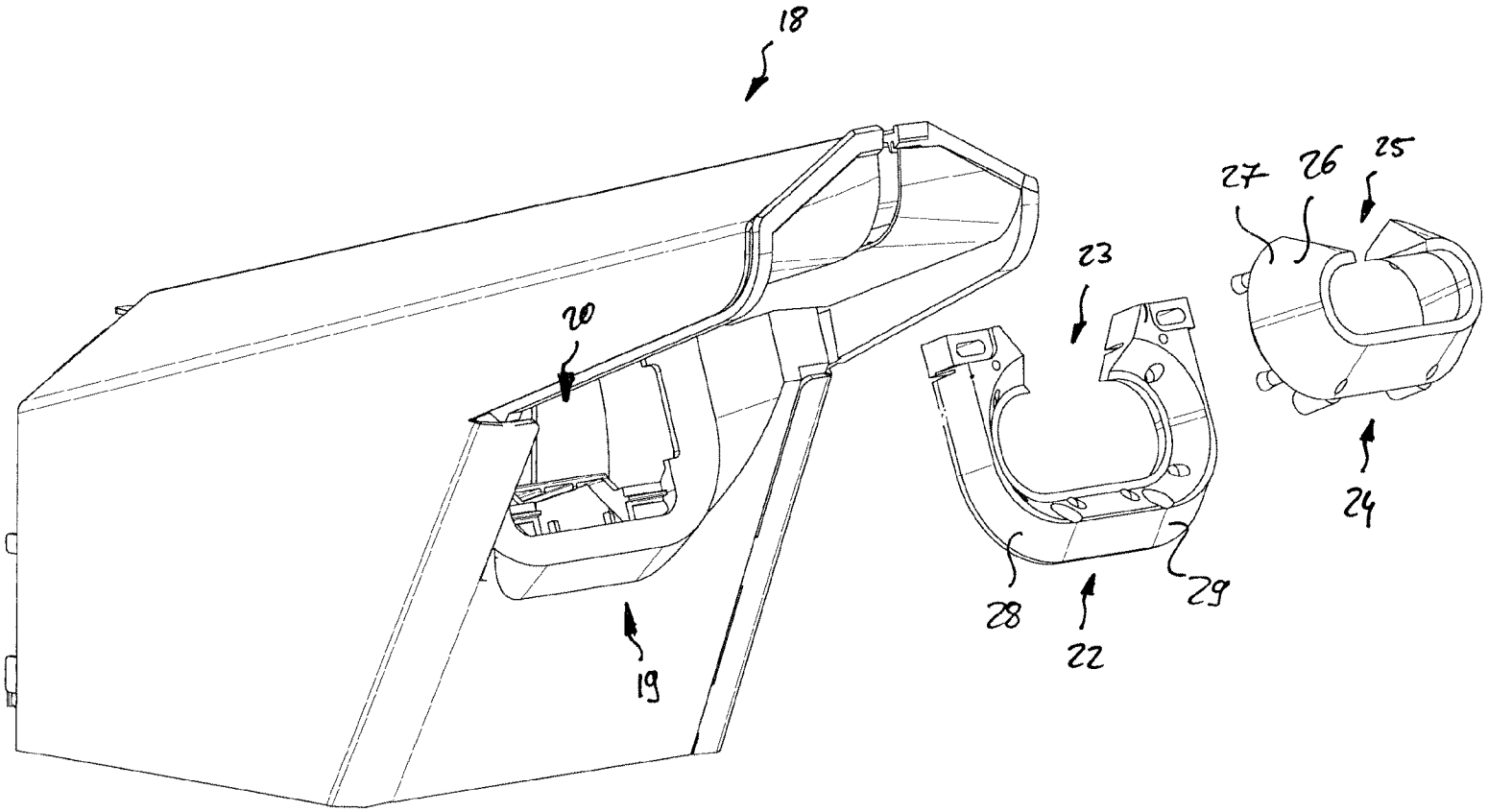
FIG. 4 depicts an explosive perspective view of a handrail exit/entry box according to an exemplary embodiment of the invention.
Figure 5:
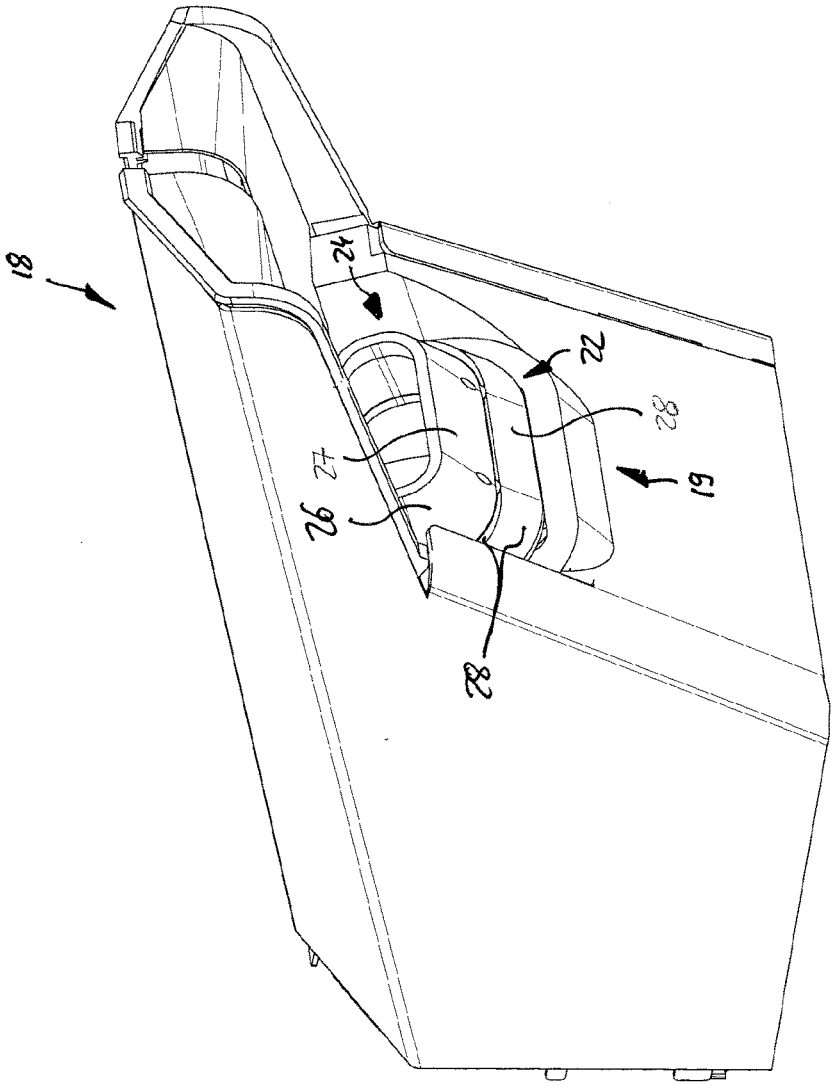
FIG. 5 depicts a perspective view of the handrail exit/entry box shown in FIG. 4 in an assembled state.

FIG. 4 depicts an explosive perspective view of a handrail exit/entry box 18 according to an exemplary embodiment of the invention. FIG. 5 shows the same handrail exit/entry box 18 in an assembled state and FIG. 6 shows a sectional view thereof.

Figure 6:
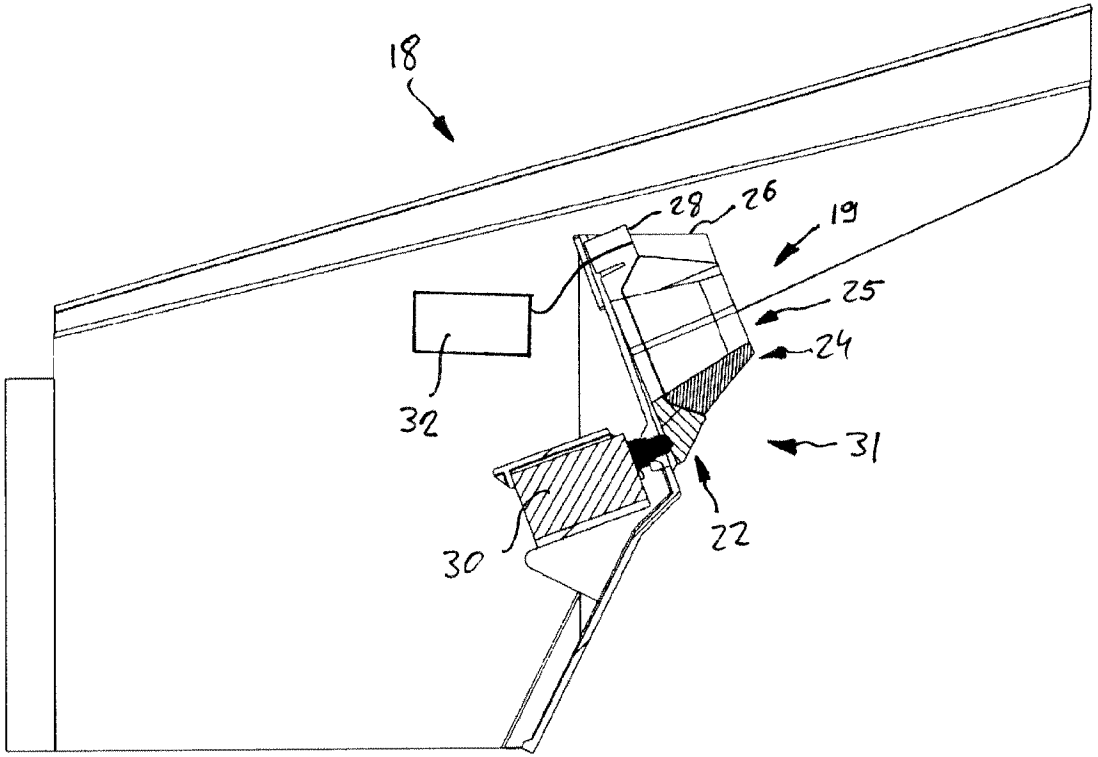
FIG. 6 depicts a sectional view of the handrail exit/entry box shown in FIG. 5.

The handrail exit/entry box 18 comprises an opening 20 for receiving a lower return portion of the handrail 10, which is not shown in FIGS. 4 to 6. The opening 20 is partially surrounded by a movably mounted switching element 22, which in particular may be a rockable element. The switching element 22 supports a cap 24. In the assembled state, which is shown in FIG. 5, the opening 20, an opening 23 formed within the switching element 22 (see FIG. 4) and an opening 25 formed within the cap 24 (see FIG. 4) are coaxially aligned. The handrail 10, which is not shown in FIGS. 4 to 6, extends trough said openings 20, 23, 25.

A safety switch 30 (see FIG. 6), which in particular may be a mechanical safety switch and which is not visible in FIGS. 4 and 5, is provided within the handrail exit/entry box 18. The safety switch 30, the switching element 22 and the cap 24 constitute a safety switch assembly 31. The safety switch 30 is configured to be activated by the switching element 22 when it is pushed towards the handrail exit/entry box 18, e.g. by a finger residing on the return portion of the handrail 10 (not shown) entering into the coaxially aligned openings 20, 23, 25.

As a result, in case a part of a human body, e.g. a finger, is pressed against the cap 24 and/or the switching element 22 and moves the switching element 22 towards the handrail exit/entry box 18, the safety switch 30 is activated. When the safety switch 30 is activated, any movement of the handrail 12 is stopped in order to avoid that the part of the human body touching the cap 24 and/or the switching element 22 is pulled into the opening 25 and squeezed between the rim of the opening 25 and the handrail 12, which may result in severe injuries.

Furthermore, at least one of the outer surfaces 26, 28 of the cap 24 and/or of the switching element 22 is configured as a sensor surface 27, 29 for providing, in combination with a corresponding detection circuit 32, a touch sensor, which allows to detect a part of a human body touching or approaching the at least one of the outer surfaces 26, 28 of the cap 24 and/or of the switching element 22.

The touch sensor may be a capacitive sensor which is configured for detecting a change of capacity caused by the part of the human body approaching or touching the at least one of the outer surfaces 26, 28. Alternatively, the touch sensor may be an electrical sensor, which is configured for detecting a (small) electrical current flowing through a human body touching the at least one of the outer surfaces 26, 28. In order to provide the desired sensor surface 27, 29, the outer surfaces 26, 28 of the cap 24 and/or the switching element 22 may be covered with an appropriate metallic or non-metallic, but electrically conductive, coating.

In an alternative embodiment the touch sensor may be an optical sensor comprising at least one optical sensor element which reacts on shading at least one of the outer surfaces 26, 28 by means of a part of a human body.

A touch sensor, as it has been described before, allows to detect a severe risk that a part of a human body gets trapped and injured at a very early stage, in particular even before the switching element 22 is moved. Thus, the touch sensor allows to issue an alarm signal even before the switching element 22 is moved and the safety switch 30 is activated. In consequence, an alarm signal may be issued in order to cause the human to remove his/her part of the body from the handrail exit/entry portion 19. Alternatively or additionally the speed of the handrail 12, and optionally the speed of the conveying element 8, may be reduced for reducing the risk of pulling the detected part of the human body into the openings 20, 23, 25.

In consequence, there is some chance that the part of the human body touching or approaching the cap 24 is removed in time and thus there may be no need for stopping the movement of the handrail 12 (and optionally the conveying element 8) completely. As a result, the shut-off times of the people conveyor 2 may be reduced.

In case no part of a human body is detected in the vicinity of the cap 24 for at least a predetermined amount of time, the speed of the handrail 12 (and optionally the speed of the conveying element 8) may be increased back to normal speed without human intervention in order to return to normal operation.

A number of optional features are set out in the following. These features may be realized in particular embodiments, alone or in combination with any of the other features.

In an embodiment the safety switch assembly may comprise a switching element which is configured for activating a safety switch when moved and which extends at least partially around the handrail exit/entry portion. Such a switching element results in a reliable activation of the switch. A switching element extending at least partially around the handrail exit/entry portion is reliably activated by parts of a human body touching the handrail in the vicinity of the handrail exit/entry portion.

In an embodiment the safety switch may be a mechanical switch. A mechanical switch provides a reliable and inexpensive safety switch. Alternatively, the safety switch may be an optical switch, e.g. a switch comprising a light barrier which is blocked when the switch is activated.

In an embodiment the sensor surface may be provided on an outer surface of the switching element in order to cause the touch sensor to be activated when the outer surface of the switching element is touched.

In an embodiment the touch sensor may be provided as a capacitive sensor which is configured for detecting a change of capacity caused by an approaching portion of a human body. Capacitive sensors provide reliable and inexpensive touch sensors, which are able to detect parts of the human body approaching and/or touching the sensor surface.

In an embodiment the touch sensor may be provided as an electrical sensor which is configured for detecting an electrical current flowing through a human body. Such electrical sensors provide reliable and inexpensive touch sensors, which are able to detect parts of the human body touching the sensor surface.

In an embodiment the touch sensor may be provided as an optical sensor which is configured for optically detecting a portion of a human body approaching and/or touching the sensor surface. Optical sensors provide reliable and inexpensive touch sensors, which are able to detect parts of the human body approaching and/or touching the sensor surface.

In an embodiment the people conveyor may be configured for issuing an optical alarm signal and/or an acoustic alarm signal in case the touch sensor detects a part of a human body approaching and/or touching the sensor surface. Thus, a method of operating a people conveyor may include issuing an optical and/or acoustical alarm signal in case the touch sensor detects any part of a human body, in particular a finger, approaching and/or touching the sensor surface.

An optical alarm signal and/or an acoustic alarm signal may cause a human being to remove the detected part of his/her body from the entry portion before it is trapped or jammed within the opening. In case the part of the human body is removed in time, it may not be necessary to stop the movement of the handrail of the people conveyor. Thus, an inconvenient shutoff of the people conveyor may be avoided.

In an embodiment the people conveyor may be configured for reducing the speed of the handrail in case the touch sensor detects a part of a human body approaching and/or touching the sensor surface. Thus, method of operating a people conveyor may include reducing the speed of the handrail element in case the touch sensor detects any part of a human body, in particular a finger, approaching and/or touching the sensor surface.

Reducing the speed of the handrail may allow a human being to remove the detected part of his/her body from the entry portion before it is trapped or jammed within the opening. In case the part of the human body is removed in time, it may not be necessary to stop the movement of the handrail of the people conveyor. Thus, an inconvenient shutoff of the people conveyor may be avoided.

In an embodiment the people conveyor may be configured for reducing the speed of the conveying element together with the handrail in order to avoid a speed difference between the conveying element and the handrail.

In an embodiment the people conveyor may be configured for increasing the speed of the handrail, and of the conveying element if applicable, back to normal operational speed in case the touch sensor does no detect a part of a human body approaching and/or touching the sensor surface for at least a predetermined period of time. This allows the people conveyor to return to normal operation without human intervention.

In an embodiment the people conveyor may be an escalator including a conveying element comprising a plurality of steps. Alternatively, the people conveyor may be a moving walkway including a conveying element comprising a plurality of pallets.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

2 people conveyor
3 truss
4 lower landing area
6 upper landing area
8 conveying element
10 handrail
12 balustrade
14 lower base portion of the balustrade
16 upper portion of the balustrade
18 handrail exit/entry box
19 handrail exit/entry portion
20 opening in the handrail exit/entry box
22 switching element
23 opening in the switching element
24 cap
25 opening in the cap
26 surface of the cap
27 sensor surface
28 surface of the switching element
29 sensor surface
30 safety switch
31 safety switch assembly
32 detection circuit

What is claimed is:

1. A people conveyor comprising:

two landing areas located at two opposing ends of the people conveyor;

a movable conveying element extending between the two landing areas and configured for conveying passengers between the two landing areas;

a handrail extending parallel to the conveying element between the two landing areas and configured for moving with the conveying element;

a handrail exit/entry portion located at one of the landing areas and configured for receiving a return portion of the handrail; and a safety switch assembly provided at the handrail exit/entry portion and configured for stopping the handrail when activated;

wherein the safety switch assembly comprises at least one sensor surface providing a touch sensor for detecting any part of a human body approaching and/or touching at least one of the at least one sensor surfaces;

wherein the safety switch assembly comprises a switching element which is configured for activating a safety switch when moved, the switching element extending at least partially around the handrail.

2. The people conveyor according to claim 1, wherein at least one of the at least one sensor surfaces is provided on an outer surface of the switching element.

3. The people conveyor according to claim 1, wherein the touch sensor is provided as a capacitive sensor which is configured for detecting a change of capacity caused by an approaching portion of a human body.

4. The people conveyor according to claim 1, wherein the touch sensor is provided as an electrical sensor which is configured for detecting an electrical current flowing through a human body.

5. The people conveyor according to claim 1, wherein the touch sensor is provided as an optical sensor which is configured for optically detecting a portion of a human body approaching and/or touching at least one of the at least one sensor surfaces.

6. The people conveyor according to claim 1, which is configured for issuing an optical alarm signal and/or an acoustic alarm signal in case the touch sensor detects a part of a human body approaching and/or touching at least one of the at least one sensor surfaces.

7. The people conveyor according to claim 1, which is configured for reducing the speed of the handrail in case the touch sensor detects a part of a human body approaching and/or touching at least one of the at least one sensor surfaces.

8. The people conveyor according to claim 7, which is configured for reducing the speed of the conveying element in case the touch sensor detects a part of a human body approaching and/or touching at least one of the at least one sensor surfaces.

9. The people conveyor according to claim 1, wherein the people conveyor is an escalator including a conveying element comprising a plurality of steps.

10. The people conveyor according to claim 1, wherein the people conveyor is a moving walkway including a conveying element comprising a plurality of pallets.

11. A method of operating a people conveyor according to claim 1, wherein the method comprises:

issuing an optical and/or acoustical alarm signal in case the touch sensor detects any part of a human body approaching and/or touching at least one of the at least one sensor surfaces.

12. The method of operating a people conveyor according to claim 11, further comprising stopping any movement of the handrail in case the safety switch is activated.

13. The method of operating a people conveyor according to claim 1, wherein the method comprises:

reducing the speed of the handrail element in case the touch sensor detects any part of a human body approaching and/or touching at least one of the at least one sensor surfaces.

14. A people conveyor comprising:

two landing areas located at two opposing ends of the people conveyor;

a movable conveying element extending between the two landing areas and configured for conveying passengers between the two landing areas;

a handrail extending parallel to the conveying element between the two landing areas and configured for moving with the conveying element;

a handrail exit/entry portion located at one of the landing areas and configured for receiving a return portion of the handrail; and a safety switch assembly provided at the handrail exit/entry portion and configured for stopping the handrail when activated;

wherein the safety switch assembly comprises at least one sensor surface providing a touch sensor for detecting any part of a human body approaching and/or touching at least one of the at least one sensor surfaces;

wherein the speed of the handrail is reduced when the touch sensor detects a part of a human body approaching and/or touching at least one of the at least one sensor surfaces;

wherein the speed of the handrail and/or of the conveying element is increased to normal operational speed when the touch sensor does not detect a part of a human body approaching and/or touching the at least one sensor surface for at least a predetermined period of time.

* * * * *